US006400922B2

(12) United States Patent
Kakuguchi et al.

(10) Patent No.: US 6,400,922 B2
(45) Date of Patent: Jun. 4, 2002

(54) IMAGE-FORMING DEVICE HAVING A PLURALITY OF IMAGE-FORMING UNITS RESPECTIVELY APPLY THE DIFFERENCE FORCE TO THE RECORDABLE MEDIUM

(75) Inventors: Kazuhiro Kakuguchi; Satoshi Seino; Michio Shimura; Morihisa Kawahara; Tetsuya Takei; Hisashi Hanzawa; Yutaka Sato, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/754,295

(22) Filed: Jan. 5, 2001

(30) Foreign Application Priority Data

Jul. 13, 2000 (JP) ..... 2000-213241

(51) Int. Cl.[7] ..... G03G 15/01

(52) U.S. Cl. ..... 399/298; 399/66; 399/299; 399/313; 399/318

(58) Field of Search ..... 399/66, 67, 298, 399/299, 303, 312, 313, 314, 318, 328, 339, 388

(56) References Cited

U.S. PATENT DOCUMENTS 5,678,150 A * 10/1997 Takahashi et al. ..... 399/299

FOREIGN PATENT DOCUMENTS

JP 10-221910 8/1998

* cited by examiner

*Primary Examiner*—Sophia S. Chen
*Assistant Examiner*—Hoang Ngo
(74) *Attorney, Agent, or Firm*—Armstrong, Westerman & Hattori, LLP

(57) ABSTRACT

It is an exemplified object of the present invention to provide an image-forming device that can form a high-quality multicolor image at relatively low cost. To achieve the above object, the inventive image-forming device includes an endless belt that conveys a recordable medium; plural image-forming units that form a toner layer on the recordable medium via the endless belt; and a fixer that fixes the toner layer on the recordable medium, and a first pressing force applicable to the recordable medium by a last image-forming unit at a downstream side along a direction in which the recordable medium is conveyed among the plural image-forming units is greater than a second pressing force applicable to the recordable medium by another image-forming unit adjacent to the last image-forming unit at the downstream side among the plural image-forming units.

9 Claims, 9 Drawing Sheets

IMAGE-FORMING DEVICE HAVING A PLURALITY OF IMAGE-FORMING UNITS RESPECTIVELY APPLY THE DIFFERENCE FORCE TO THE RECORDABLE MEDIUM

BACKGROUND OF THE INVENTION

The present invention relates generally to image-forming devices, and more particularly to a conveyance of a recordable medium in a multicolor image-forming device. The present invention is suitable, for example for an electrophotographic image-forming device such as a multicolor page printer. Paper (or printing paper) is used as exemplary of a recordable medium to be conveyed in the inventive device, but it is to be understood that other media such as an OHP film are not excluded from applicable media, and a range of usable media is not limited to a specific size or thickness of the sheet.

The "multicolor page printer" as used herein, which is also called multicolor tandem printer, typically employs a plurality of transfer sections, and adopts a method employing a plurality of process units arranged in tandem, each having the transfer section. However, the present invention is not restricted to devices using a process-color printing method that represents full-color images by four colors in yellow (Y), magenta (M), cyan (C), and black (B), but also applicable to devices using a spot-color printing method that employs colored materials in a specific color (e.g., gold, silver, or fluorescent colors). The "electrophotographic image-forming device" by which we mean is an image-forming device employing the Carlson process described in U.S. Pat. No. 2,297,691, as typified by a laser printer, and denotes a nonimpact image-forming device that provides recording by depositing a developing agent as a recording material on a recordable medium. The image-forming device according to the present invention is broadly applicable not only to a discrete printer, but also to various apparatuses having a recording function such as a photocopier, a facsimile unit, a computer system, a word processor, and a combination machine thereof.

With the recent development of office automation, the use of electrophotographic image-forming devices for computer's output devices, facsimile units, photocopiers, etc. has spread steadily. The demand for multicolor printing rather than a single-color printing is expected to grow more and more in future, for example, in the realm of multicolor laser printers and LED printers for computer outputs, or PPC multicolor copiers realized by a combination of a color scanner and an imaging function by a microprocessor, or the like.

The multicolor tandem printer typically includes a register section, a plurality of process units capable of generating a plurality of colors (image-forming units), and a fixer. The process units are arranged in tandem with respect to a sheet conveying direction, for example, in the order of Y, M, C, and K, from upstream to downstream of the sheet conveying direction. Process-color images are formed by a combination of four colors in Y, M, C, and K, and therefore four process units are normally provided in the multicolor tandem printer.

The register section typically includes a pair of rollers disposed between a pick roller that dispenses out sheets of paper from a paper tray or paper cassette, and a yellow process unit. The register section comes in contact with a top edge of the sheet dispensed out from the pick roller, thereby straightens up an orientation of the sheet, and conveys the same to the yellow process unit.

Each process unit generally includes a photoconductive insulator (photosensitive drum), a charger, an exposure section, a development section, and a transfer section. The charger electrifies the photosensitive drum uniformly (e.g., at −700 V ). The exposure section irradiates a laser light or the like on the photosensitive drum, and neutralizes a potential on an irradiated area (to −50 V or so), to form an electrostatic latent image. The development section electrically deposits a developing agent onto the photosensitive drum using, for example, the reversal process, and visualizes the electrostatic latent image. The reversal process is a development method that forms an electric field by a development bias in areas where electric charge is eliminated by exposure to light, and deposits the developing agent having the same polarity as uniformly charged areas on the photosensitive drum by the electric field. The transfer section forms a toner image corresponding to the electrostatic latent image on a sheet of paper, using, for example, a transfer roller.

The multicolor image-forming device in many instances uses a paper conveyance mechanism that electrostatically adsorbs a sheet of paper onto an endless belt (or transfer belt), to convey the sheet at the same speed as the belt moves. The transfer belt is typically provided so as to be sandwiched between the photosensitive drum and the transfer section in each process unit, and to run between the process units (between yellow and black process units in the above example). Since the transfer roller is pressed onto the transfer belt to bring the sheet into contact with the photosensitive drum for a transfer process, the sheet and the photosensitive drum may easily be brought into intimate contact with each other, and thus a high-quality transferred image may be obtained.

The steps of charging, exposure to light, development, and transfer are repeated four times for four colors in four process units, and a four-fold toner layer is transferred onto a recordable medium. In after-processes, the photosensitive drum from which toner has been transferred is neutralized and cleaned, and residual toner is collected, and recycled and/or disposed. Like this, a multicolor image is represented as a combination and overlap of four colors.

The fixer, which is typically comprised of a pair of rollers, fixes the toner layer onto a sheet of paper, and conveys the sheet along a sheet conveying direction. More specifically, the fixer fuses a toner image by applying heat, pressure, or the like, thereby permanently fixes a color image on the recordable medium, and then conveys the sheet in the sheet conveying direction to a next stage.

However, a conventional multicolor tandem printer is disadvantageously susceptible to relative displacement of each color (i.e., colors likely to be out of register), and unlikely to provide high image quality. The color displacement, which results from a variation of sheet conveyance speeds, is produced between the register section and each process unit, and between each process unit and the fixer, but in principle does not occur between four process units.

The reason why no color displacement is caused between four process units is that each process unit usually uses the same components (a drum, a gear and other parts) and the same topology, and therefore the color displacement is negligible if dimensional and/or driving errors and eccentricity of the components in each process unit are negligible, and that the transfer belt serves to keep the sheet conveyance at a constant speed.

Conversely, the reason why the color displacement is caused between the register section and each process unit, and between each process unit and the fixer is that structures (dimensional accuracy of parts such as a roller's diameter) and driving forces vary from component to component. Even if the numbers of revolutions of driving sources of each component in the register section, the process units, and the fixer are adjusted, a roller's diameter or the like are altered over time, which causes speeds of each component to vary. In addition, the pattern and time of the speed variation are not constant.

With consideration given to the above, it would be a conceivable idea that the transfer belt might be extended from the register section to the fixer, to maintain a transfer speed from the register section to the fixer. However, such an extension of the transfer belt to the register section would prevent the register section from coming into contact with a top edge of the sheet, and thus from serving to straighten up an orientation of the sheet (i.e., to align the sheet orientation in the sheet conveying direction). Moreover, the extension of the transfer belt to the fixer would damage the transfer belt due to heat generated in the fixer. Therefore, it is technically difficult to extend the transfer belt from the register section to the fixer.

Further, it would also be a conceivable idea that a variation of the sheet conveyance speed might be detected and fed back to control the sheet conveyance, to prevent the color displacement, however, such a method of preventing the color displacement increases the complexity and cost of the device. Therefore, it is technically and cost-effectively difficult to control a variation of the sheet conveyance speeds in each section.

BRIEF SUMMARY OF THE INVENTION

Therefore, it is an exemplified general object of the present invention to provide a novel and useful image-forming device, in which the above conventional disadvantages are eliminated.

To be more specific, it is an exemplified object of the present invention to provide an image-forming device that can form a high-quality multicolor image at relatively low cost.

In order to achieve the above objects, an image-forming device as one exemplified embodiment of the present invention comprises an endless belt that conveys a recordable medium; plural image-forming units that form a toner layer on the recordable medium via the endless belt; and a fixer that fixes the toner layer on the recordable medium, and a first pressing force applicable to the recordable medium by a last image-forming unit at a downstream side along a direction in which the recordable medium is conveyed among the plural image-forming units is greater than a second pressing force applicable to the recordable medium by another image-forming unit adjacent to the last image-forming unit at the downstream side among the plural image-forming units. According to a conventional image-forming device in which plural image-forming units respectively apply the same force to the recordable medium, at a downstream side along a direction in which the recordable medium is conveyed, a variation rate is large between a pressing force applied to the recordable medium by an image-forming unit at a downstream end and another image-forming unit adjacent to the image-forming unit, and a pressing force applied only by the image-forming unit at the downstream end. However, in the inventive image-forming device, the first pressing force applicable to the recordable medium by the endmost downstream image-forming unit is set to be larger than the second force applicable to the recordable medium by another image-forming unit adjacent to the image-forming unit, and thus the above-described variation rate may be reduced. Accordingly, the instant image-forming device may produce a printed output having reduced color displacement derived from the variation rate.

An image-forming device as another exemplified embodiment of the present invention comprises an endless belt that conveys a recordable medium; plural image-forming units that form a toner layer on the recordable medium via the endless belt; and a register section that conveys the recordable medium to the endless belt, and a fourth pressing force applicable to the recordable medium by a first image-forming unit at an upstream side along a direction in which the recordable medium is conveyed among the plural image-forming units is greater than a fifth pressing force applicable to the recordable medium by another image-forming unit adjacent to the last image-forming unit at the upstream side among the plural image-forming units. According to a conventional image-forming device in which plural image-forming units respectively apply the same force to a recordable medium, at an upstream side along a direction in which the recordable medium is conveyed, a variation rate is large between a pressing force applied only by the image-forming unit at the upstream end, and a pressing force applied to the recordable medium by an image-forming unit at an upstream end and another image-forming unit adjacent to the image-forming unit. However, in the inventive image-forming device, the fourth pressing force applicable to the recordable medium by the foremost upstream image-forming unit is set to be larger than the fifth force applicable to the recordable medium by another image-forming unit adjacent to the image-forming unit, and thus the above-described variation rate may be reduced. Accordingly, the instant image-forming device may produce a printed output having reduced color displacement derived from the variation rate.

Other objects and further features of the present invention will become readily apparent from the following description of the embodiments with reference to accompanying drawings.

DETAILED DESCRIPTION OF THE INVENTION

Figure 1:
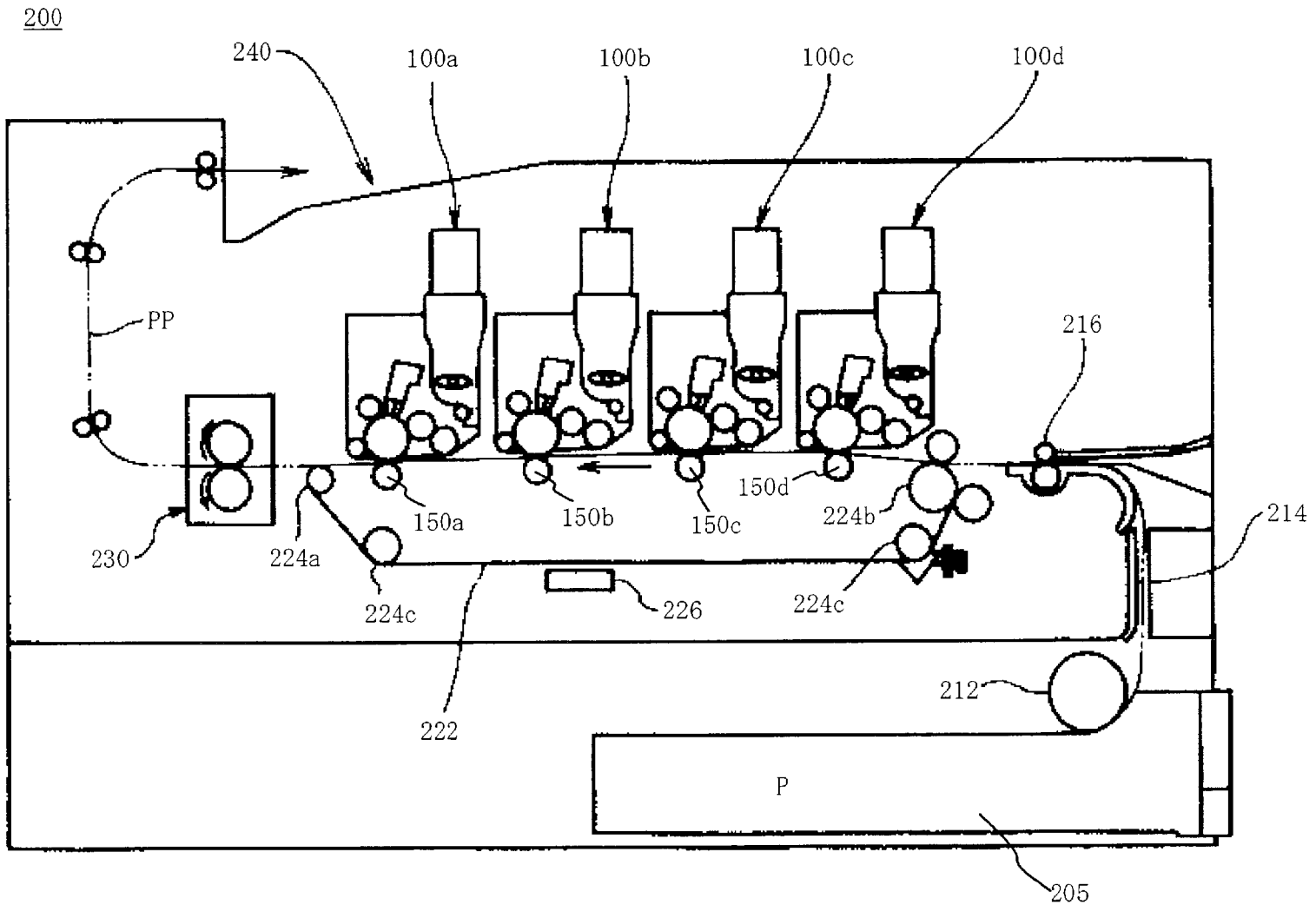
FIG. 1 is a schematic sectional view of a multicolor image-forming device including a plurality of process units.

A description will now be given of a structure of a multicolor image-forming device 200 having process units 100*a* through 100*d* as one exemplified embodiment of the present invention, with reference to FIG. 1. In each figure, those elements designated by the same reference numerals denote the same elements, and a duplicate description thereof will be omitted. Like reference numerals with a capital alphabetic letter attached thereto generally designate a variation of the elements identified by the reference numerals, and reference numerals without an alphabetic letter, unless otherwise specified, comprehensively designate the element identified by the reference numerals with an alphabetic letter. Hereupon FIG. 1 is a schematic sectional side view of the multicolor image-forming device 200 including a plurality of the process units 100*a* through 100*d*.

The multicolor image-forming device 200 includes a hopper 205, a register section 210, a sheet conveyor section 220, four process units 100*a* through 100*d*, a fixer 230, and a stacker 240. The present embodiment employs four colors of black (K), cyan (C), magenta (M), and yellow (Y), which are respectively allotted to the process units, i.e., black (K) to the process unit 100*a*, cyan (C) to the process unit 100*b*, magenta (M) to the process unit 100*c*, and yellow (Y) to the process unit 100*d*. It is to be understood that the number of colors in the present invention is not limited to four. In addition, the process units 100 in the present embodiment are, needless to say, applicable to both of single-sided and double-sided printing.

The hopper 205, which is also called a sheet feed tray or sheet feed cassette, stores more than one sheet of printing paper P. The register section 210, which is called a feeder section, picks up a sheet on top of the sheets of paper P placed on the hopper 205, and feeds the same to the sheet conveyor section 220. The register section includes a pickup roller 212, a sheet guide 214, and a sheet feed roller 216. The pickup roller 212 is brought into contact with the topmost sheet of paper P stacked on the hopper 205, and dispenses the sheets one by one. The sheet guide 214 guides each sheet of paper P dispensed by the pickup roller 212 to the sheet feed roller 216. The sheet feed roller 216 aligns an edge of the sheet with an edge of an image, and dispenses the sheet to the sheet conveyor section 220.

The sheet conveyor section 220 receives the sheet of paper P from the register section 210, and coveys the same along a sheet conveyor path PP to the fixer 230 provided in an upper portion of the device. Since a toner image formation (or transfer process) is carried out during the conveyance of the sheet by the process units 100*a* through 100*d*, the sheet conveyor section 220 is called a transfer section. The sheet conveyor section 220 includes a conveyor belt 222, a roller 224, and a sensor The conveyor belt 222, which is an endless belt, is sandwiched between the photosensitive drum 111 and transfer roller 150 in each process unit 100, and rotates to the left (counterclockwise). The conveyor belt 222 is made of a permeable dielectric material such as a synthetic resin. The conveyor belt 222 rotates and moves by torque of the photosensitive drum 110 that will be explained later, force (pressing force) of the transfer roller 150 against the photosensitive drum 110, and torque of a driving roller 224*b*. The sheet of paper P conveyed from the register section 210 is electrostatically adsorbed to the conveyor belt 222, and thus moves at the same speed as a moving speed of the conveyor belt 222 without slipping out of proper position. Therefore, the sheet of paper P adsorbed on the conveyor belt 222 is pressed to the photosensitive drum 110 by the transfer roller 150, and thus the sheet of paper P and the photosensitive drum may easily be brought into intimate contact with each other, whereby a high-quality transferred image is obtained. Like this, the conveyor belt 222 closely relates to the transfer process, and therefore is also called a transfer belt.

The conveyor belt 222 also serves to convey the sheet of paper P at a constant speed between each process unit 100. Accordingly, in order to form a high-quality image, it would be a conceivable idea that the conveyor belt 222 might be extended from the register section 210 to the fixer 230 so as to convey the sheet of paper P at a constant speed from the beginning of feeding to the end of dispensing the sheet. However, such an extension of the conveyor belt 222 would disadvantageously prevent the register section 210 from coming into contact with a top edge of the sheet to align an edge of the sheet with an edge of the image, and deform or damage the transfer belt 222 due to heat and pressure in the fixer 230; therefore, it is technically difficult to extend the conveyor belt 222.

The roller 224 comprises a driven roller 224*a*, a driving roller 224*b*, a guide roller 224*c*, and serves to rotate the conveyor belt 222. A top side of traveling portion of the conveyor belt 222 between the driven roller 224*a* and the driving roller 224*b* forms a moving path of a sheet of paper P. The driven roller 224*a* is disposed in a position close to the register section 210, and serves to charge the conveyor belt 222 so as to electrostatically adsorb the sheet of paper P. The driving roller 224*b* is disposed in a position close to the fixer 230, and serves to eliminate charge from the conveyor belt 222. Accordingly, charge on the conveyor belt 222 is eliminated in a portion that comes in contact with the driving roller 224*b*. Consequently, elimination of charge from the sheet of paper P while passing through the driving roller 224 facilitates flaking off the sheet from the conveyor belt 222, and the sheet is conveyed to the fixer 230.

As shown in FIG. 1, on a bottom belt surface of the conveyor belt 222 preferably is provided a sensor 226 parallel to a belt-moving direction. The sensor 226 optically reads a register mark on the conveyor belt 222, and detects a misalignment of the conveyor belt 222. In operation, a sheet of paper P is conveyed to the conveyor belt 222 by the sheet feed roller 216. Thereafter, the sheet of paper P is electrostatically adsorbed onto the conveyor belt 222 that rotates to the left by the driving roller 224*b* and the photosensitive drum 110, conveyed between the photosensitive drum 110 and the conveyor belt 222 in the process unit 100, and dispensed through the fixer 230 to the stacker 240. A detailed description of the sheet conveyor section 220 will be given later with reference to FIGS. 3 through 10.

Figure 2:
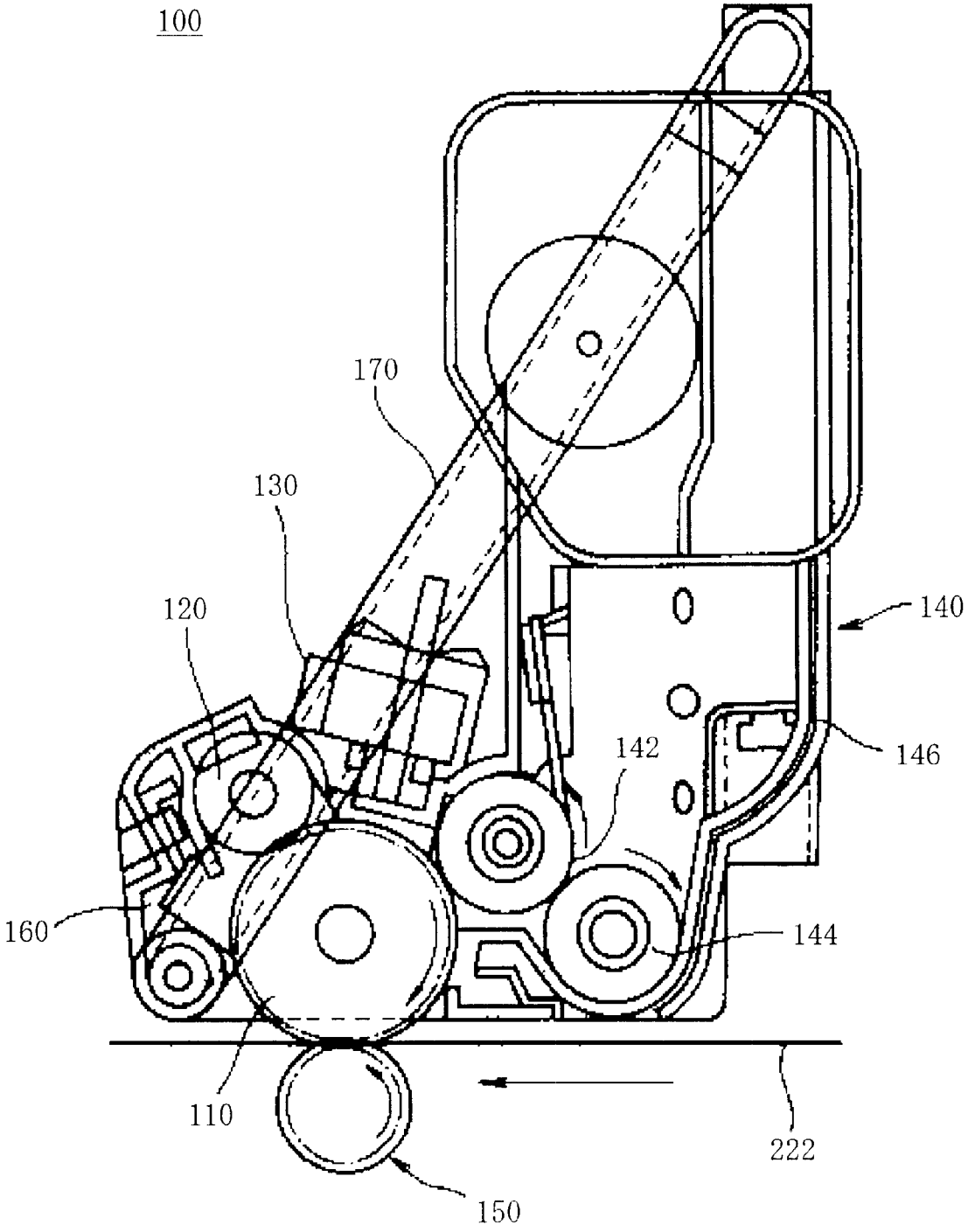
FIG. 2 is a schematic sectional view of the inventive process unit shown in FIG. 1.

The process unit 100 serves to form (transfer) a desired toner image on the printing paper P. As shown in FIG. 1, the four process units 100*a* through 100*d* and fixer 330 are aligned in a straight line. The process unit 100 is, as shown in FIG. 2, includes a photosensitive drum 110, a pre-charger 120, an exposure device 130, a development device 140, a transfer roller 150, a cleaning section 160, and a screw conveyor 170. FIG. 2 is a schematic sectional view of an exemplified process unit 100 according to the present invention. Incidentally, particular attention should be paid to the fact that the process units 100*a* through 100*d* as shown in FIG. 1 have different transfer rollers 150*a* through 150*d* (each having different pressing force).

The photosensitive drum 110 includes a photosensitive dielectric layer on a rotatable drum-shaped conductor support, and is used for an image holding member. The photosensitive drum 110, which is, for instance, made by applying a function separation-type organic photoreceptor with a thickness of about 20 μm on a drum made of aluminum, has an outer diameter 30 mm, and rotates at a circumferential velocity of 70 mm/s to move the conveyor belt 222 in a direction indicated by an arrow. The pre-charger 120 is, for instance, comprised of a corona-electrifying device or scorotron-electrifying device, and gives a constant amount of electric charges (e.g., about −700 V) on the photosensitive drum 110.

The exposure device 130 includes, for instance, an LED array as an optical writing unit. When the light is irradiated and scans by the LED array on the photosensitive drum 110, the uniform charge at the irradiated area on the photosensitive drum 110 corresponding to the image is eliminated through exposure to light, and a latent image is formed. To be more specific, light-emitting devices arranged in a main scanning direction of the LED array is driven according to the levels of tone of imaging data (dot data) converted from image data provided as printing information from a host device such as a computer, and a word-processor. Consequently, the electrostatic latent image is written as a dot image.

The development device 140 serves to visualize a latent image formed on the photosensitive drum 110 into a toner image. The development device 140 includes a development roller 142, a reset roller 144, and a toner cartridge 146. In the present embodiment toner of four colors such as cyan (C), magenta (M), yellow (Y), and black (K) is used for a developing agent as an example. The developing agent may include one or two components (i.e., it may include a carrier) without distinction as to whether it is magnetic or nonmagnetic. The toner cartridge 146 stores toner and supplies toner to the reset roller 144. The reset roller 144 comes into contact with the development roller 142, and supplies toner to the development roller 142. The reset roller 142 is placed in or out of contact with the photosensitive drum 110, and supplies toner to the photosensitive drum 110 by electrostatic force. Consequently, a toner image is formed on the photosensitive drum 110. Unused toner remaining on the development roller 142 is collected by the reset roller 144 and brought back into the toner cartridge 146.

The transfer roller 150 generates an electronic field to electrostatically adsorb toner, and transfers the toner image adsorbed on the photosensitive drum 110 onto a sheet of paper P. The transfer roller 150 is, as shown in FIG. 2, opposed to the photosensitive drum 110 through the conveyor belt 222. The transfer roller 150 is also disposed to press the conveyor belt 222 to the photosensitive drum 110 by a pressing mechanism (not shown). Therefore, when a sheet of paper P is conveyed to a transfer position by the conveyor belt 222, the above pressing mechanism is actuated, and presses the transfer roller 150 to the photosensitive drum 110. This pressing force with torque of the photosensitive drum 110 and driving force of the driving roller 224*b* would initiate the rotation and movement of the conveyor belt 222.

The cleaning section 160 collects and disposes of toner remaining on the photosensitive drum 110 after the transfer process, or as necessary returns the toner collected by the screw conveyor 170 to the toner cartridge 146. The cleaning section 160 also serves to collect debris on the photosensitive drum 110. The cleaning section 160 may utilize varied kinds of means including magnetic force and rubber friction to remove the toner and charges on the photosensitive drum 110.

The fixer 230 serves to permanently fix a toner image (toner layer) onto a sheet of paper P. The fixer 230 includes an upper fixing roller 232U, and a lower fixing roller 232L, and the above-mentioned sheet conveyance force C is produced by the upper fixing roller 232U and the lower fixing roller 232L. The upper fixing roller 232U and the lower fixing roller 232L are disposed parallel to and in contact with each other, and a nip N is formed therebetween. Materials used for the fixing rollers 232U and 232L vary with the uses, and fluorocarbon rubber, silicone rubber, or the like may be employed. The upper fixing roller 232U and the lower fixing roller 232L incorporate a halogen lamp or the like as a heating source, and may produce heat, for instance, to 170° C. through 190° C. A thermistor (not shown) is provided to detect surface temperature on the rollers 232U and 232L. In addition, a high pressure, for example, at 33 atm is applied between the upper fixing roller 232U and the lower fixing roller 232L. Toner transferred onto a sheet of paper P is fixed by the high temperature and high pressure. To be more specific, the transferred toner is adhered onto a sheet of paper P only with a weak force, and thus easily fallen off. Therefore, the fixer 230 fuses the toner by pressure and heat to imbue the sheet of paper P with the toner. Energy required to fix the toner layer for a multicolor image formation is greater than that for a single-color image formation. To the stacker 240, a sheet of paper P is dispensed out after printing is completed.

Figure 3:
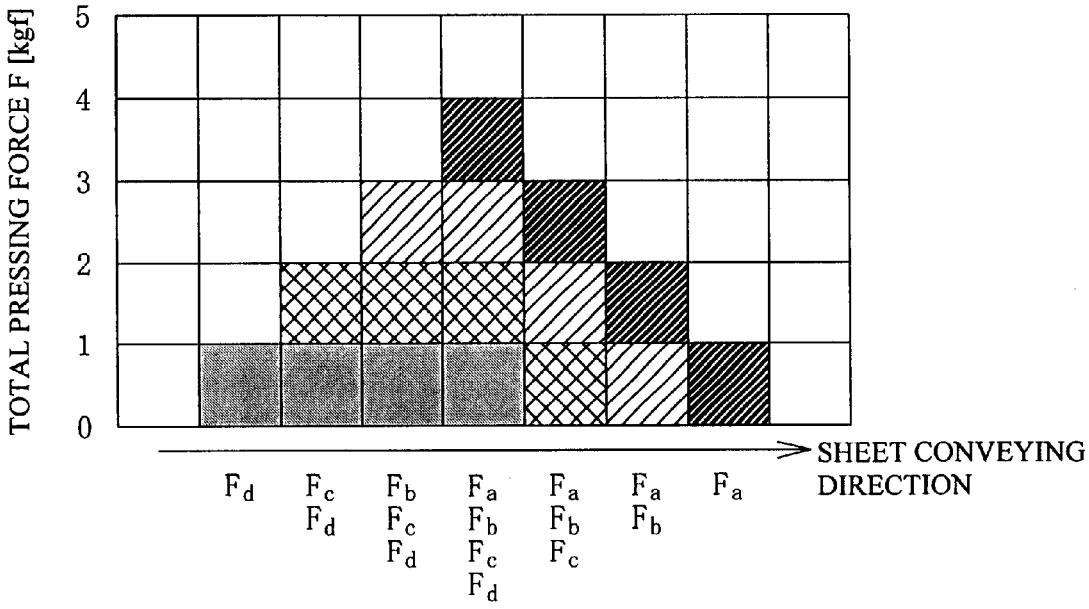
FIG. 3 is a schematic status diagram for explaining a sheet conveyance force when pressing forces by transfer rollers are the same.

Referring now to FIG. 3, a description will be given of a total pressing force F applied to a sheet of paper P by the transfer rollers 150*a* through 150*d*. Normally, pressing forces $F_a$, $F_b$, $F_c$, and $F_d$ applied to a sheet of paper P (conveyor belt 222) by the transfer rollers 150*a* through 150*d* are the same among each transfer roller 150*a* through 150*d*. If the pressing forces $F_a$ through $F_d$ are the same, a transition of the total pressing force applied to the entirety of a sheet of paper P may be as shown in FIG. 3. FIG. 3 is a schematic status diagram for explaining a transition of the total pressing force F applied to the entirety of a sheet of paper P when the pressing forces $F_a$ through $F_d$ are the same. In FIG. 3, the pressing forces $F_a$ through $F_d$ applied by the transfer rollers 150*a* through 150*d* are set at 1 kgf. The sheet of paper P used for explaining the status as shown in FIG. 3 requires at least as long as a length allowing the pressing forces $F_a$ through $F_d$ to be applied from all the four process units 100*a* through 100*d*.

When a sheet of paper P that passes through the sheet feed roller 216 passes in orderly sequence through the process units 100*a* to 100*d*, the total pressing force F=0 in an initial stage, as long as the sheet is brought into contact with the process unit 100*d*. As the conveyance of the sheet of paper P proceeds, and when the process unit 100*d* starts a transfer operation for the sheet of paper P, the total pressing force F becomes 1 kgf because the pressing force $F_d$32 1 kgf is applied by the transfer roller 150*d*. Next, as the pressing force $F_c$ by the transfer roller 150*c* in the process unit 100*c* is applied to the transfer roller 150*d* in the process unit 100*d*, the total pressing force F becomes $F_c+F_d=2$ kgf. Then,the pressing force $F_b$ by the transfer roller 150*b* in the process unit 100*b* is added, and the total pressing force F becomes $F_b+F_c+F_d=3$ kgf. Further, thereafter, the pressing force $F_a$ by the transfer roller 150*a* in the process unit 100*a* is added, and the total pressing force F reaches $F_a+F_b+F_c+F_d=4$ kgf.

Subsequently, as the sheet of paper P is conveyed further, the pressing force $F_d$ applied by the transfer roller 150*d* in the process unit 100*d* becomes lost, and the total pressing force F becomes $F_a+F_b+F_c=3$ kgf. Thereafter, the total pressing force F applied to the sheet of paper P decreases further in sequence, so that F becomes $F_a+F_b=2$ kgf, and then reaches $F_a=2$ kgf. Like this, if the number of the process unit 100 provided is four, and the pressing forces $F_a$ through $F_d$ are the same, the total pressing force F varies with time from the minimum 1 kgf to the maximum 4 kgf according to the conveyance condition of the sheet of paper P. Until an edge of the sheet of paper P conveyed from the register section 210 has not reached the process unit 100*d*, the total pressing force applied to the sheet of paper P keeps 0.

A distance between the transfer rollers 150*a* through 150*d* in the process units 100*a* through 100*d* in the image-forming device 200 used in the present embodiment is approximately 89 mm. Therefore, the total pressing force F assumes varied maximum values depending upon the size of the sheet of paper P (paper size). For instance, the width (length of shorter side) of A5-size paper is 148.5 mm, and the transfer roller 150 may press the sheet of paper P simultaneously at two places. Therefore, when printing is carried out using A5-size paper in a landscape orientation, the maximum value of the total pressings force F is 2 kgf.

Referring now to FIGS. 4 to 8 inclusive, a description will be given of typical patterns of color displacement. The color displacement is caused by a variation of sheet conveyance speeds between the register section 210 and process unit 100 (sheet conveyor section 220), and between the process unit 100 (sheet conveyor section 220) and fixer 230. The sheet conveyance speeds of the register section 210, the process unit 100 (sheet conveyor section 220), and the fixer 230 are herein respectively indicated by $S_{210}$, $S_{220}$, and $S_{230}$. FIGS. 4 through 8 show printed outputs from an image-forming device having the process unit 100 of which the total pressing force F changes as in FIG. 3.

Figure 4:
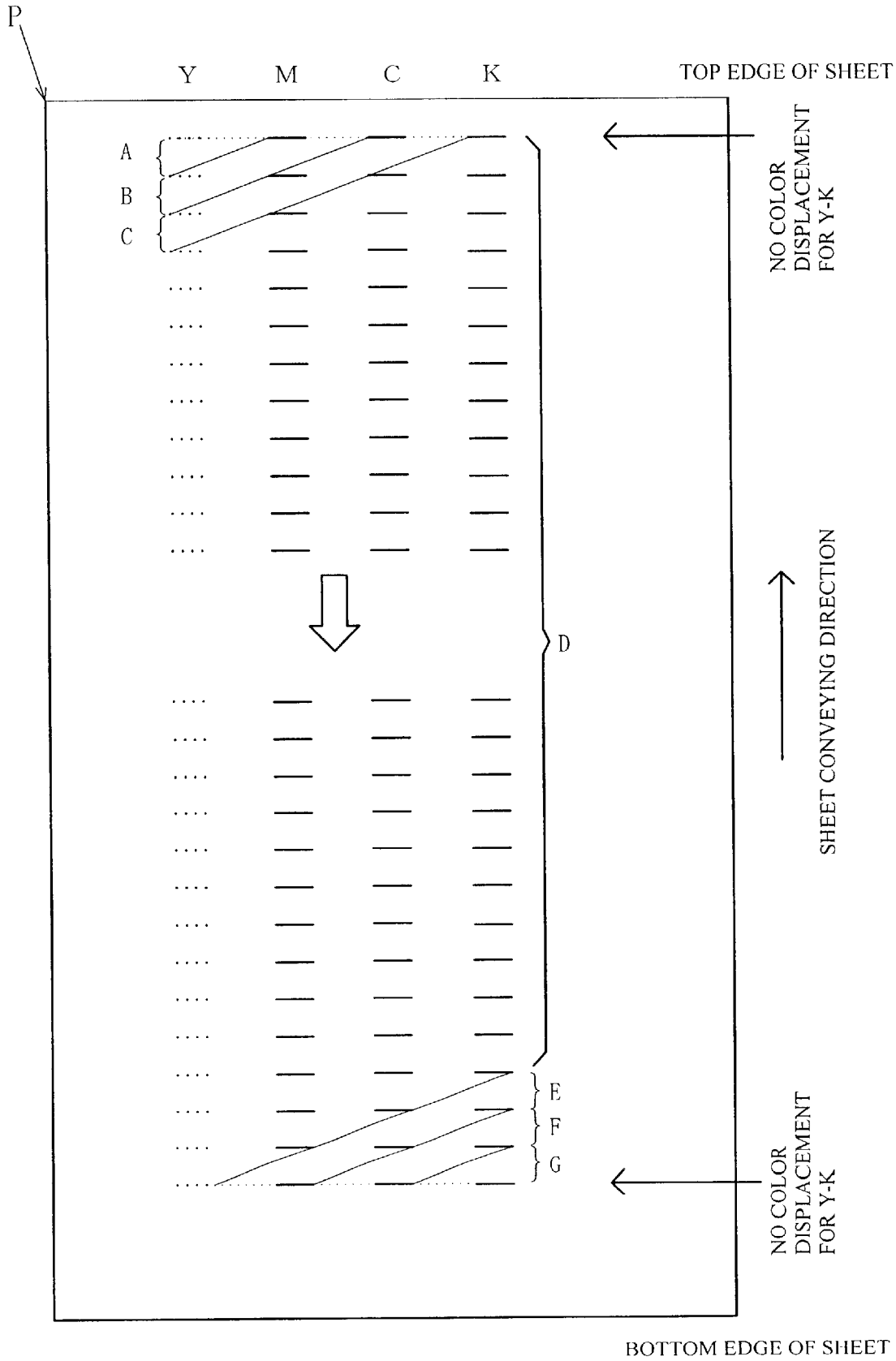
FIG. 4 is a status diagram that illustrates an ideal printed output.

A printed output without color displacement is shown in FIG. 4. This printed output is obtainable, for example, by printing such data as to form four-color superimposed lines having fixed spacing under the condition that the sheet conveyance speed $S_{210}$, the sheet conveyance speed $S_{220}$, and the sheet conveyance speed $S_{230}$ agree with each other. However, in FIG. 4, each color line is shifted in print position in order to distinctly indicate a difference of print timing and displacement among each color caused by varied conveyance speed of the sheet of paper p. FIG. 4 is a diagram showing an ideal printed output.

The uppermost yellow line is printed by the process unit 100*d* that is first reached by a sheet of paper p conveyed to the sheet conveyor section 220. Thereafter, as the sheet of paper p is further conveyed, the uppermost magenta line and the second yellow line are simultaneously printed by the process units 100*c* and 100*d*. Then, as the sheet of paper P is further conveyed, the uppermost cyan line, the second magenta line, and the third yellow line are simultaneously printed by the process units 100*b* through 100*d*. As the sheet of paper P is further conveyed, the uppermost black line, the second cyan line, the third magenta line, and the fourth yellow line are simultaneously printed by the process units 100*a* through 100*d*.

Subsequently, simultaneous printing of the nth yellow line, (n−1)th magenta line, (n−2)th cyan line, and (n−3)th black line is continuously carried out. Then, as the conveyance of the sheet of paper P proceeds to the bottom edge, and when printing of the lowermost yellow line is completed, the sheet of paper P is separated from the process unit 100*d*. As the sheet of paper P is further conveyed, the lowermost magenta line, the lowermost cyan line, and the lowermost black line are printed in this sequence. After printing of the lowermost black line is completed, the sheet of paper P is separated from the process unit 100*a*.

Referring next to FIG. 4, a description will be given of a transition of the total pressing force F applied to a sheet of paper P with a print area divided into seven from A to G. In the area A, printing of the yellow line is initiated, and only the pressing force $F_d$ by the transfer roller 150*d* in the process unit 100*d* is applied to the sheet of paper P; thus the total pressing force F satisfies $F=F_d$. In the area B, printing of the magenta line is initiated, the printing of yellow and magenta lines become possible, and thus the pressing forces $F_c$ and $F_d$ by the transfer rollers 150*c* and 150*d* in the process units 100*c* and 100*d* are applied to the sheet of paper P, so that the total pressing force F becomes $F=F_C+F_d$. In the area C, printing of the cyan line is further initiated the printing of three color lines become possible and thus the pressing forces $F_b$ through $F_d$ by the transfer rollers 150*b* through $\mathbf{150}_d$ in the process units 100*b* through 100*d* are applied to the sheet of paper P, so that the total pressing force F becomes $F=F_b+F_c+F_d$. Furthermore, in the area D, printing of the black line is initiated, and the pressing forces $F_a$ through $F_d$ by the transfer rollers 150*a* through 150*d* in the process units 100*a* through 100*d* are applied to the sheet of paper P, so that the total pressing force F becomes $F=F_a+F_b+F_c+F_d$.

In addition, in the area E, as the printing of the yellow line is completed, the total pressing force F becomes $F=F_a+F_b+F_c$. In the area F, the printing of the magenta line is completed as well, and thus the total pressing force F becomes $F=F_a+F_b$. In the area G, the printing of the cyan line is completed, and thus the total pressing force F becomes $F=F_a$. According to the printed output shown in FIG. 4, the total pressing force F represents the maximum value in the areas A and G, and the minimum value in the area D.

Figure 5:
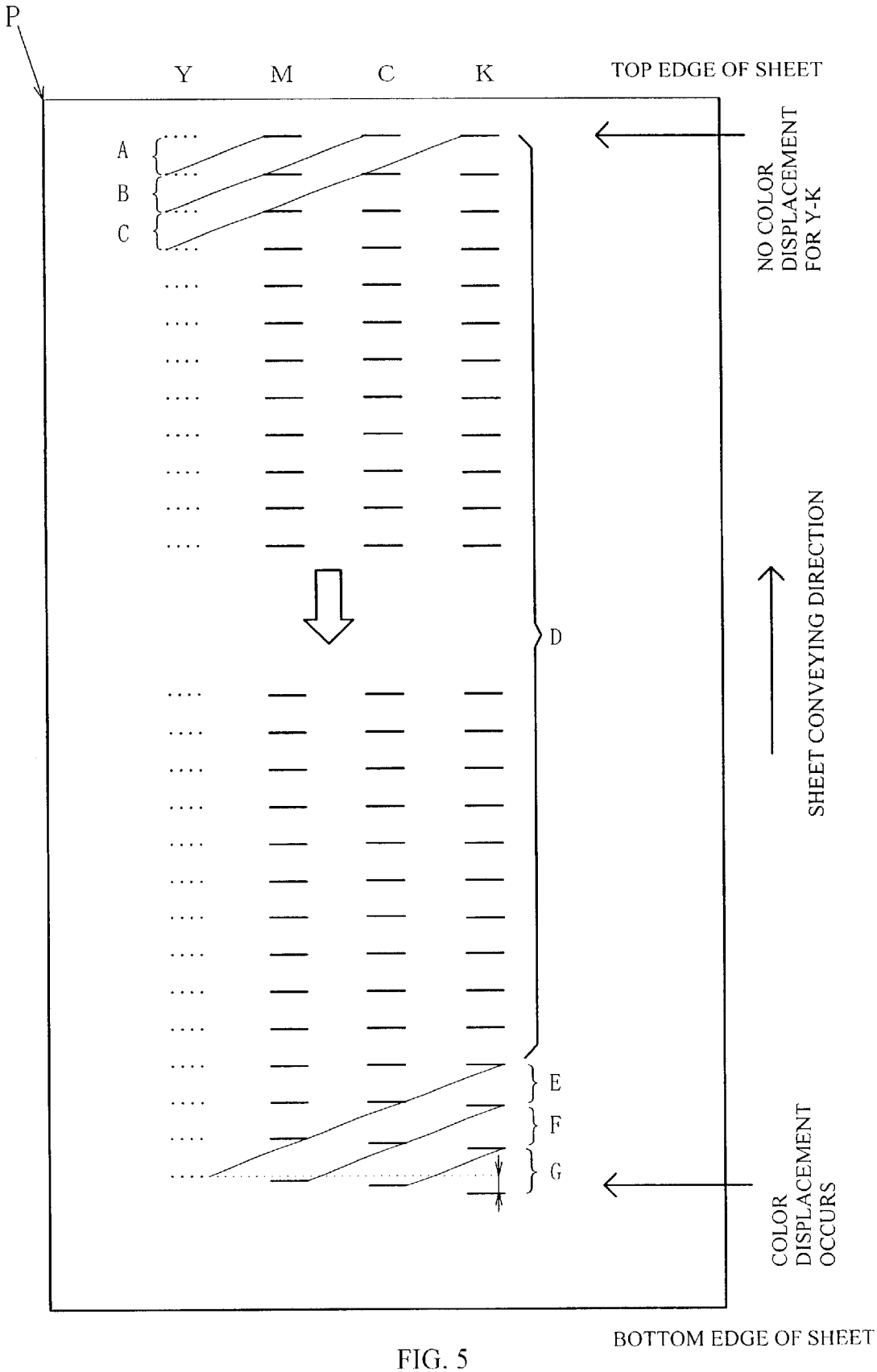
FIG. 5 is a diagram that illustrates a printed output when such a relationship that a sheet conveyance speed $S_{220}$<a sheet conveyance speed $S_{230}$ is established.

However, if the sheet conveyance speed $S_{220}$ and the sheet conveyance speed $S_{230}$ are not the same, and a relationship as represented in the following expression is established: SHEET CONVEYANCE SPEED $S_{220}$(in the sheet conveyor section 220)>SHEET CONVEYANCE SPEED $S_{230}$(in the fixer 230), then the printed output is as shown in FIG. 5. Assume that the printed output is not affected by the sheet conveyance speed $S_{210}$ in the register section 210. The printed output shown in FIGS. 5 through 8 that will be described below is obtainable, as shown in FIG. 4, by printing such data as to form four-color superimposed lines having fixed spacing. In FIGS. 5 through 8 as well, each color line is shifted in print position in order to distinctly indicate a difference of print timing and displacement among each color. A print area is divided into seven from A to G as in FIG. 4. A relationship between the print area and the total pressing force F is the same as described with reference to in FIG. 4. FIG. 5 is a diagram showing a printed output when such a relationship is established as represented in: SHEET CONVEYANCE SPEED $S_{220}$<SHEET CONVEYANCE SPEED $S_{230}$.

As shown in FIG. 5, the printed output has no color displacement in an upper portion of the sheet, and thus represents an ideal result. This is because an increase of the total pressing force F with movement of the print area from the area A to the area D on a sheet of paper P would prevent the sheet from being easily dragged to the fixer 230 even if printing is started under the condition that the fixer 230 is pulling a sheet of paper P. Therefore, if SHEET CONVEYANCE SPEED $S_{220}$<SHEET CONVEYANCE SPEED $S_{230}$ is established, the topmost edge of the sheet of paper P is unsusceptible to color displacement.

On the other hand, in a lower portion of the sheet, displacement of the magenta line, the cyan line, and the black line occurs in a direction opposite the sheet conveyance direction with respect to the yellow line that is formed first among the bottommost lines. To be specific, the magenta line, the cyan line, and the black line are printed in a shifted position rearward in the sheet conveyance direction from a normal position in which these lines should be formed in line with the yellow line. Moreover, with respect to the bottommost yellow line, an amount of the displacement increases in the order of the magenta line, the cyan line, and the black line. Accordingly, the bottommost black line and yellow line are most conspicuously shifted.

Figure 6:
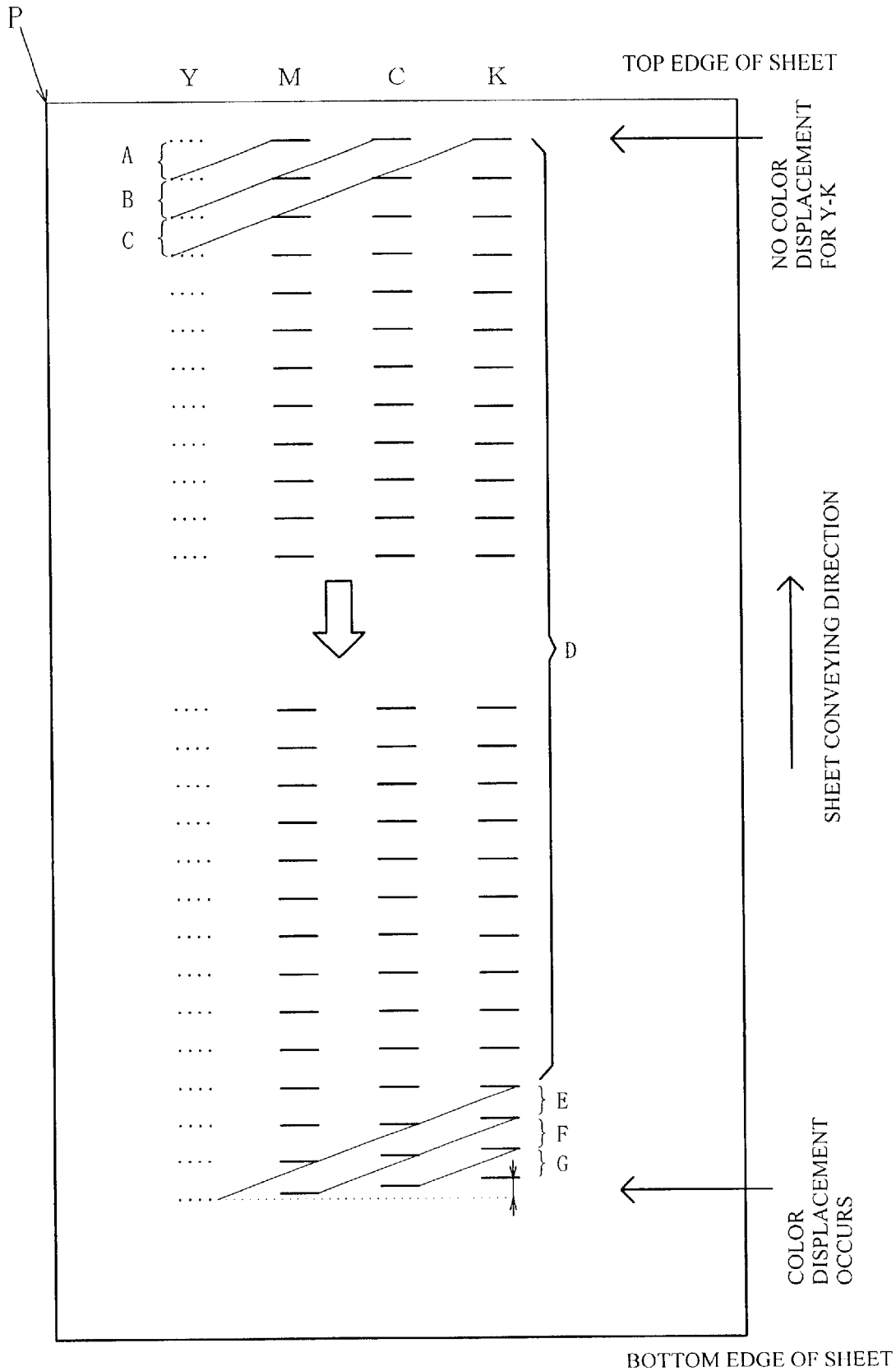
FIG. 6 is a diagram that illustrates a printed output when such a relationship that a sheet conveyance speed $S_{220}$>a sheet conveyance speed $S_{230}$ is established.

If a relationship as represented in the following expression is established: SHEET CONVEYANCE SPEED $S_{220}$>SHEET CONVEYANCE SPEED $S_{230}$, then the printed output is as shown in FIG. 6. The printed output shown in FIG. 6 is illustrated, as in FIGS. 4 and 5 by shifting each color line in print position in order to distinctly indicate a difference of print timing and displacement among each other. FIG. 6 is a diagram showing a printed output when such a relationship is established as represented in: SHEET CONVEYANCE SPEED $S_{220}$>SHEET CONVEYANCE SPEED $S_{230}$. Assume that this printed output is not affected by the sheet conveyance speed $S_{210}$ in the register section 210. As shown in FIG. 6, the printed output has no color displacement in a bottom edge of the sheet, and thus represents an ideal result, but an amount of the displacement increases in the order of magenta, cyan, and black in the same direction as the sheet conveyance direction. This phenomenon may vary in accordance with rigidity of paper to be conveyed. When a thin sheet of paper as usually used is printed, sag is formed in the sheet of printing paper between the sheet conveyor section 220 and the fixer 230 if the sheet conveyance speed $S_{220}$ is higher than the sheet conveyance speed $S_{230}$. However, when a thick and stiff sheet of paper or cardboard is printed, sag is hard to form in the sheet of printing paper. Therefore the sheet conveyor section 220 presses the sheet of paper P against the fixer 230, and thus the sheet is conveyed in the fixer 230 at a speed higher than the sheet conveyance speed $S_{230}$, whereby color displacement occurs. In other words, color displacement as in FIG. 6 would occur if a thick and stiff sheet of paper such as cartridge paper were used. In this case, as shown in FIG. 6, the black line is most conspicuously shifted relative to the yellow line, in particular.

Figure 7:
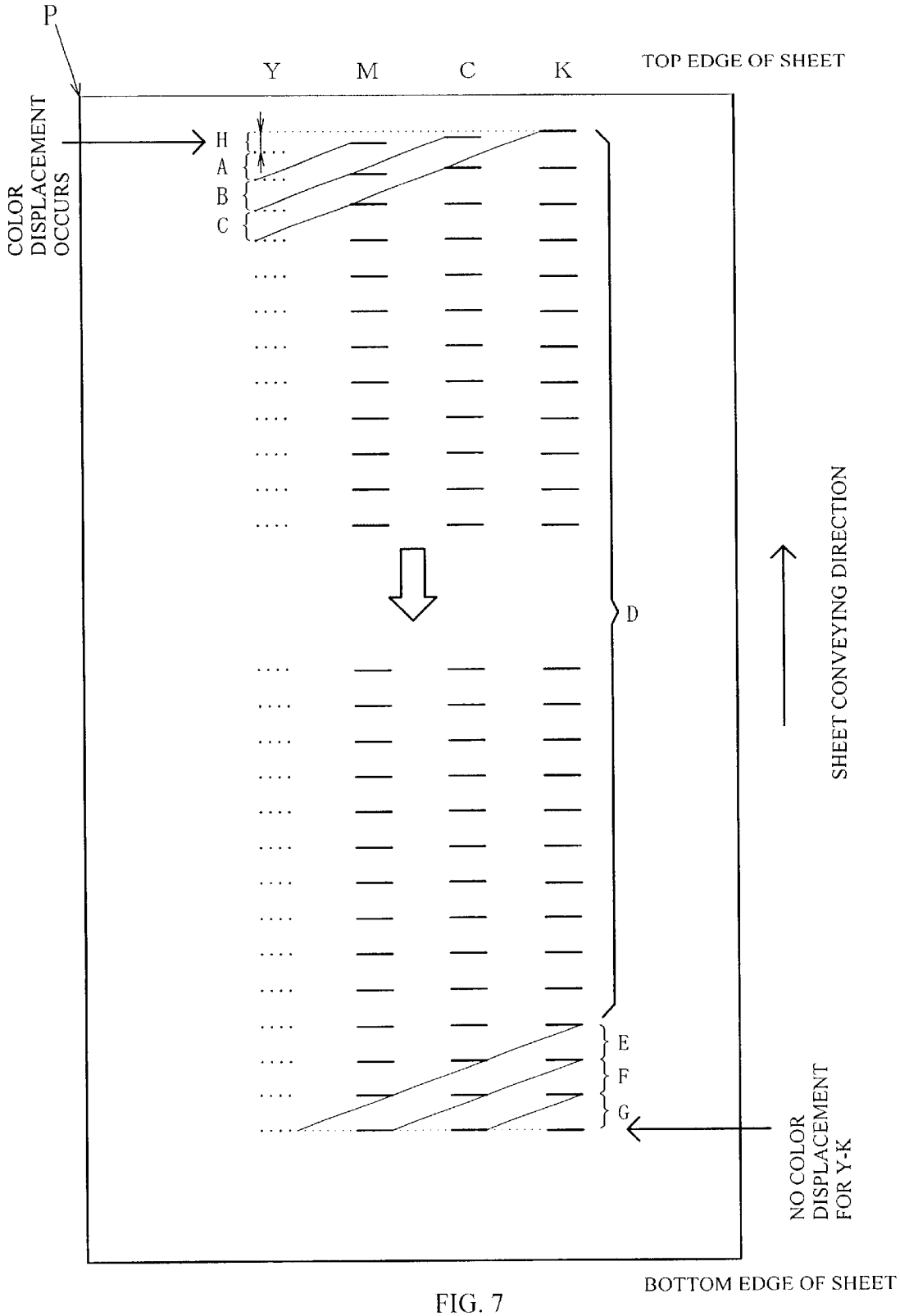
FIG. 7 is a diagram that illustrates a printed output when such a relationship that a sheet conveyance speed $S_{220}$>a sheet conveyance speed $S_{210}$ is established.

Similarly, if the sheet conveyance speed $S_{220}$ and the sheet conveyance speed $S_{210}$ are not the same, and a relationship as represented in the following expression is established: SHEET CONVEYANCE SPEED $S_{220}$ (in the sheet conveyor section 220)>SHEET CONVEYANCE SPEED $S_{210}$ (in the register section 210), then the printed output is as shown in FIG. 7. FIG. 7 is a diagram showing a printed output when such a relationship is established as represented in: SHEET CONVEYANCE SPEED $S_{220}$>SHEET CONVEYANCE SPEED $S_{210}$. Assume that this printed output is not affected by the sheet conveyance speed $S_{230}$ in the fixer 230. In FIG. 7, a print area is divided into eight from A to H. As shown in FIG. 7, in an upper portion of the sheet, displacement of the cyan line, the magenta line, and the yellow line occurs in a direction opposite the sheet conveyance direction with respect to the black line that is formed last among the topmost lines. To be specific, the cyan line, the magenta line, and the yellow line are printed in a shifted position rearward in the sheet conveyance direction from a normal position in which these lines should be formed in line with the black line. Moreover, with respect to the topmost black line, an amount of the displacement increases in the order of the cyan line, the magenta line, and the yellow line. Accordingly, the topmost yellow line and black line are most conspicuously shifted.

On the other hand, the printed output has no color displacement in a lower portion of the sheet, and thus represents an ideal result. This is because an increase of the total pressing force F with movement of the print area from the area A to the area D on a sheet of paper P while the conveyance of the sheet proceeds would prevent the sheet from being dragged to the register section 210 even if color displacement occurs in a topmost portion. Therefore, if SHEET CONVEYANCE SPEED $S_{220}$>SHEET CONVEYANCE SPEED $S_{210}$ is satisfied, the bottommost edge of the sheet of paper P is unsusceptible to color displacement.

Figure 8:
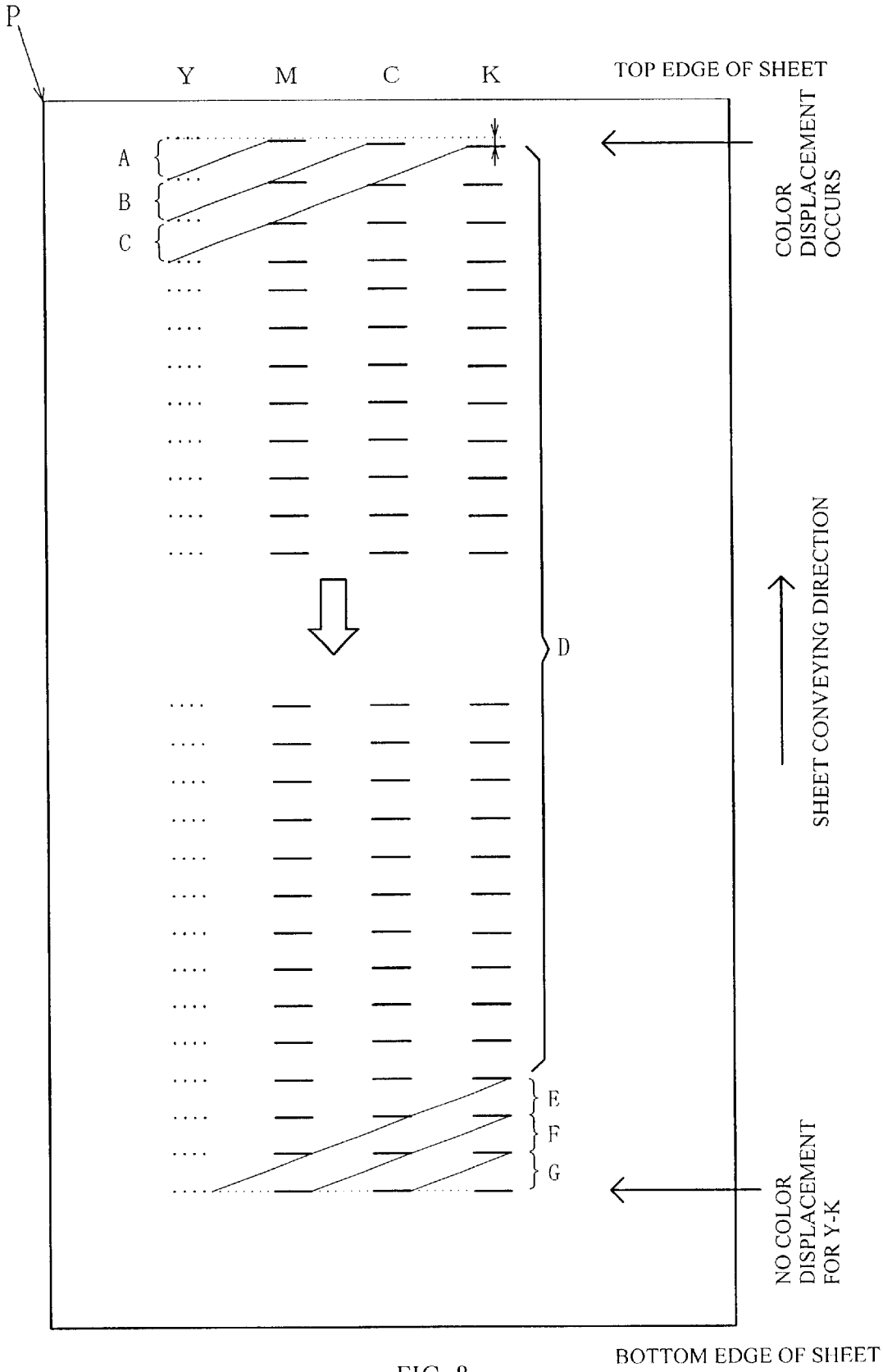
FIG. 8 is a diagram that illustrates a printed output when such a relationship that a sheet conveyance speed $S_{220}$<a sheet conveyance speed $S_{210}$ is established.

If a relationship as represented in the following expression is established: SHEET CONVEYANCE SPEED $S_{220}$<SHEET CONVEYANCE SPEED $S_{210}$, then the printed output is as shown in FIG. 8. FIG. 8 is a diagram showing a printed output when such a relationship is established as represented in: SHEET CONVEYANCE SPEED $S_{220}$<SHEET CONVEYANCE SPEED $S_{210}$. Assume that this printed output is not affected by the sheet conveyance speed $S_{230}$ in the fixer 230. As shown in FIG. 8, the printed output has no color displacement in a lower portion of the sheet, and thus represents an ideal result, but an amount of the displacement in an upper portion of the sheet increases in the order of magenta, cyan, and black in a direction opposite the sheet conveyance direction. This phenomenon may vary in accordance with rigidity of the paper to be conveyed. When a thin sheet of paper as usually used is printed, sag is formed in the sheet of printing paper between the register section 210 and the sheet conveyor section 220 if the sheet conveyance speed $S_{220}$ is higher than the sheet conveyance speed $S_{210}$. However, when a thick and stiff sheet of paper or cardboard is printed, sag is hard to form in the sheet of printing paper. Therefore, the register section 210 presses the sheet of paper P against the sheet conveyance section 210, and thus the sheet is conveyed in the sheet conveyor section 220 at a speed higher than the sheet conveyance speed $S_{220}$, whereby color displacement occurs. In other words, color displacement as in FIG. 8 would occur if a thick and stiff sheet of paper such as cartridge paper were used. In this case, as shown in FIG. 8, the black line is most conspicuously shifted relative to the yellow line, in particular.

If the color displacement, of which four patterns have been described above, were apparent to an average person's eye, a high-quality multicolor image could not be formed. It is said that human being's recognizable resolution of colors is, in general, approximately one third the resolution of black when an arithmetic mean is taken for each color. Since resolution of a black and white printer is 600 dpi (1/600 inch) on average, the occurrence of color displacement equal to or less than one third the resolution i.e., 1/200 inch (127 $\mu$m) would be considered acceptable for typical customers. To be more specific, even if displacement relative to black of the other three colors occurs, the displacement within a distance of 127 $\mu$m between an arithmetic mean of the three colors and the black would never be recognized by typical customers. In other words, when the color displacement as shown in FIGS. 5 through 8 occurs, if the greatest distance between two lines falls within 127 $\mu$m, the color displacement is not visible, and the resultant multicolor image is rated as good. However, the color displacement between the black line and the yellow line as shown in FIGS. 5 and 7 reaches approximately 300 $\mu$m, and far exceeds an acceptable value. Therefore, in order to form a high-quality multicolor image, reduction of an amount of the color displacement (e.g., between the black line and the yellow line) has presented a challenge.

As a result of a variety of investigations regarding the total pressing force F as shown in FIG. 3 and the color displacement patterns as shown in FIGS. 4 through 8, the present inventors discovered that a position in which the color displacement occurs coincides with a position in which the total pressing force F varies, and further that a variation rate of the total pressing force F, in particular, considerably affects the color displacement as shown in FIGS. 5 through 7. The color displacement as shown in FIGS. 5 and 7 may occur irrespective of the thickness and rigidity of paper.

As shown in FIG. 5, if SHEET CONVEYANCE SPEED $S_{220}$<SHEET CONVEYANCE SPEED $S_{230}$ is satisfied, the color displacement occurs between the area D and the area G in a lower portion of the sheet. The variation rate of the total pressing force F when the print area moves from the area D to the area G is as follows. The displacement formed between the lowermost yellow line and magenta line is greatly affected by the variation rate of the total pressing force F when the print area moves from the area D to the area E. As shown in FIG. 3, when the print area moves from the area D to the area E, the total pressing force F varies from $F_a+F_b+F_c+F_d$=×4 kgf to $F_a+F_b+F_c$=3 kgf. Accordingly, the variation rate is $F_d/(F_a+F_b+F_c+F_d)\times100\times25(\%)$.

Similarly, the displacement formed between the lowermost yellow line and cyan line is greatly affected by the variation rate of the total pressing force F when the print area moves from the area E to the area F. When the print area moves from the area E to the area F, the total pressing force F varies from $F_a$30 $F_b$30 $F_c$32 3 kgf to $F_a+F_b$=2 kgf. Accordingly, the variation rate is $F_c(F_a+F_b+F_c)\times100\approx33(\%)$. The displacement formed between the yellow line and black line greatly affected by the variation rate of the total pressing force F when the print area moves from the area F to the area G. When the print area moves from the area F to the area G, the total pressing force F varies from $F_a+F_b$=2 kgf to $F_a$=1 kgf. Accordingly, the variation rate is $F_b/(F_a+F_b)\times100=50$ (%).

Like this, as shown in FIG. 7, if SHEET CONVEYANCE SPEED $S_{220}$>SHEET CONVEYANCE SPEED $S_{230}$ is satisfied, the color displacement occurs between the area A and the area C, and between the area H and the area A in a lower portion of the sheet. In the area H, a sheet of paper p is conveyed to the sheet conveyor section 220, and the total pressing force F=0 until the sheet is printed by the process unit 100*d*. The largest color displacement formed between the uppermost black line and yellow line is greatly affected by the variation rate of the total pressing force F when the print area moves from the area H to the area A. When the print area moves from the area B to the area C, the total pressing force F varies from F=0 to $F_d$=1 kgf, and thus remarkable color displacement occurs.

Similarly, the displacement formed between the uppermost black line and magenta line is greatly affected by the variation rate of the total pressing force F when the print area moves from the area A to the area B. When the print area moves from the area A to the area B, the total pressing force F varies from $F_d$=1 kgf to $F_{c=l\ +Fd}$=2 kgf, and thus the variation rate is $(F_c+F_d)/F_d\times100=200(\%)$. The displacement formed between the lowermost black line and cyan line is greatly affected by the variation rate of the total pressing force F when the print area moves from the area B to the area When the print area moves from the area B to the area C, the total pressing force F varies from $F_c+F_d$=2 kgf to $F_b+F_c+F_d$+1 kgf. Accordingly, the variation rate is $(F_b+F_c+F_d)/(F_c+F_d)\times100=150(\%)$.

From the above results, it turned out that the color displacement increases more, as the variation rate of the total pressing force F is greater. Therefore, reduction of the color displacement may be achieved by reducing the variation rate of the total pressing force F as described above. For example, in order to reduce the largest color displacement formed between the lowermost yellow line and black line as shown in FIG. 5, it is desirable to set the variation rate of the total pressing force F at 50% or lower. In order to reduce the largest color displacement formed between the uppermost black line and yellow line as shown in FIG. 7, it is desirable to minimize the pressing force $F_d$, and thereby minimize the variation rate of the total pressing force F. However, if the pressing force $F_d$ were minimized, the variation rate of the total pressing force when the print area moves from the area A to the area B in FIG. 7 would increase due to a relative relationship with the pressing force $F_c$ and disadvantageously increase the color displacement in the black line and magenta line. In addition, if the pressing force, $F_d$ were too smaller than the pressing force applied to a sheet of paper P by the sheet feed roller 216 to align an edge of the sheet with an edge of an image, the sheet of paper P would become hard to convey smoothly. Accordingly, if the color displacement occurs as shown in FIG. 7, it is not the largest color displacement formed between the black line and yellow line that should be largely reduced, but it is necessary to reduce the color displacement generated in each color as a whole.

Figure 9:
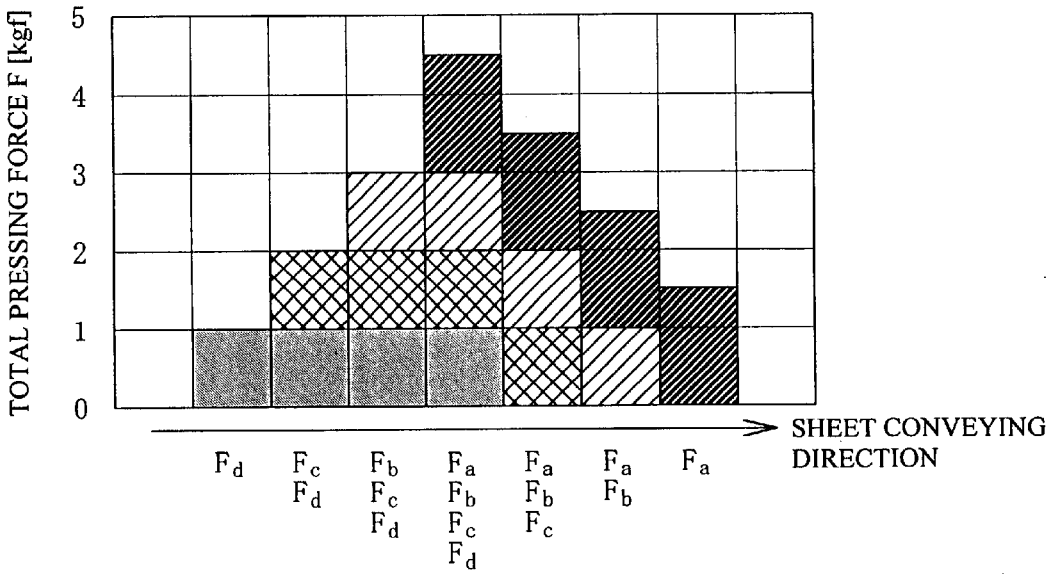
FIG. 9 is a diagram that illustrates a transition of a total pressing force F when a pressing force $F_a$ is set to be 1.5 times as large as a pressing force $F_b$.

In order to reduce the color displacement formed between the lowermost yellow line and the other lines as shown in FIG. 5, the pressing force $F_a$ of the process unit 100*a* that prints the black line is set higher than the pressing force $F_b$ of the process unit 100*b* that prints the cyan line adjacent to the black line. To be specific, the pressing force $F_a$ of the transfer roller 150*a* to the conveyor belt 222 is set 1.5 through 2.5 times larger than the pressing force F*b* of the transfer roller 150*b*. A transition of the total pressing force F where the pressing force $F_a$ is varied is shown in FIG. 9. FIG. 9 is a diagram that illustrates a transition of the total pressing force F when the pressing force $F_a$ is set to be 1.5 times as large as the pressing force $F_b$.

As shown in FIG. 9, as the conveyance of the sheet proceeds, and when printing in black is initiated, the total pressing force F drastically increases. The variation rate of the total pressing force F when the print area moves from the area C to the area D increases to 1.5 times as large as that in FIG. 3. However, although the variation rate of the total pressing force F when the print area moves from the area D to the area G as shown in FIG. 3, as described above, varies sequentially from 25% to 33%, and to 50%, the variation rate decreases so as to vary from 22% to 39%, and to 40%, because $F_a$ is set to be 1.5 times larger than $F_b$.

Figure 10:
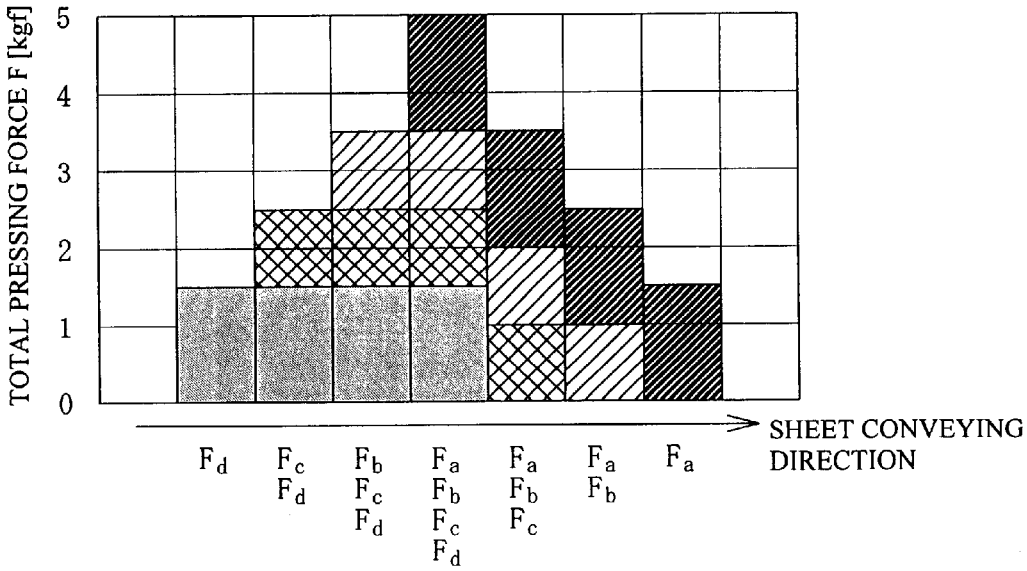
FIG. 10 is a diagram that illustrates a transition of a total pressing force F when pressing forces $F_a$ and $F_d$ are respectively set to be 1.5 times as large as pressing forces $F_b$ and $F_c$.

Furthermore, in order to reduce the color displacement formed between the lowermost yellow line and the other lines as shown in FIG. 5, and the color displacement formed between the uppermost black line and other lines as shown in FIG. 7 at the same time, the pressing forces $F_a$ and $F_d$ are respectively varied as will be described below. The pressing force $F_a$ of the process unit 100*a* that prints the black line is set larger than the pressing force $F_b$ that prints the adjacent cyan line, and the pressing force $F_d$ of the process unit 100*d* that prints the yellow line is set larger than the pressing force $F_c$ of the process unit 100$_c$ that prints the adjacent magenta line. Specifically, the pressing force $F_a$ is set 1.5–2.5 times larger than the pressing force $F_b$, and the pressing force $F_d$ is set 1.5–2.5 times larger then the pressing force $F_c$. A transition of the total pressing force F when the pressing forces $F_a$ and $F_d$ are set at varied values as described above is shown in FIG. 10. FIG. 10 is a diagram that illustrates the transition of the total pressing force F when the pressing forces $F_a$ and $F_d$ are respectively set to be 1.5 times as large as the pressing forces $F_b$ and $F_c$.

Referring to FIG. 10, as described above although the variation rate of the total pressing force F when the print area moves from the area A to the area G varies sequentially from 200% to 150%, 125%, 25%, 33%. and 50%, the variation rate changes its transition so as to vary from 166% to 140%, 143%. 30%, 29%, and 40%, because $F_a$ and $F_d$ is respectively set to be 1.5 times larger than $F_b$ and $F_c$. Here, the variation rate of the total pressing force F when the print area moves from the area C to the area D, or from the area D to the area E increases in comparison with that shown in FIG. 3. In addition, the total pressing force F when the print area moves from the area H to the area A, which is 1 kgf in FIG. 3, increases to 1.5 kgf. The increase of the variation rate would make the color displacement larger, but considering the fact that differences of lightness between each color and amounts of the color displacement between the lowermost yellow line and magenta line and between the uppermost black line and cyan line are not so large, the color displacement may be considered to decrease relatively by taking an arithmetic mean for the color displacement for each color.

Moreover, the color displacement may be reduced if the whole pressing forces $F_a$ through $F_d$ applied to a sheet of paper P by the transfer roller 150*a* through 150*d* are made larger than the pressing force applied to the sheet of paper P by the fixer 230 or the pressing force applied to the sheet of paper P by the register section 210, and thereby the transfer roller 150 even if provided in one unit is made unsusceptible to the sheet conveyance force of the fixer 230 or register section 210. However, if the whole pressing forces $F_a$ through $F_d$ were made larger, load would be applied to the rotation of the conveyor belt 222 and the rotation of the photosensitive drum 110, and thus torque of driving sources of driving motors, or the like would be required to be raised. Therefore, selective increase of $F_a$ and $F_d$ is preferable in terms of costs.

Each value of the pressing forces $F_a$ and $F_d$ is determined through an image-forming experiment that will be described in the following examples.

EXAMPLES

An image-forming experiment was carried out using the inventive image-forming device 200. The image-forming device 200 can print a sheet having a width of a longer side of A4 size paper, and thus can print a sheet up to A3 size paper. First, a pressing force $F_r$ applied to a sheet of paper P by the register section 210 was set at 19.6 N (2 kgf). In addition, a pressing force $F_t$ applied to the sheet of paper P by the upper fixing roller 232U and the lower fixing roller 232L in the fixer 230 was set at 49 N (5 kgf).

In an experiment 1, the relative pressing forces $F_b$ and $F_d$ applied to the conveyor belt 222 (photosensitive drum 110) by the transfer rollers 150*b* and 150*d* were set at 9.8 N (1 kgf). The pressing force $F_a$ by the transfer roller 150*a* was set at 14.7 N (1.5 kgf).

In an experiment 2, the relative pressing forces $F_a$ and $F_c$ applied to the conveyor belt 222 (photosensitive drum 110) by the transfer rollers 150*a* and 150*c* were set at 9.8 N (1 kgf). The pressing force $F_d$ by the transfer roller 150*d* was set at 14.7 N (1.5 kgf). If the relative pressing force of the transfer rollers 150*a* through 150*d* are set at 9.8 N (1 kgf) as in a conventional embodiment color displacement of approximately 30 μm occurs between black and yellow. However, when the image-forming experiments under the above conditions were carried out, the color displacement between black and yellow fell within 127 μm, if the sum of the pressing forces $F_a$ and $F_b$ was smaller than the pressing force $F_t$ applied to the sheet of paper P by the fixer 230 in the experiment 1, and if the pressing force $F_d$ was smaller than the pressing force $F_r$ applied to the sheet of paper P by the register section 210.

As described above, typical customers would accept the color displacement, which were, if generated, within 1/2000 inch (127 μm). Thus, another image-forming experiment was carried out under different conditions. As the conditions, a pressing force $P_a$ to the conveyor belt 222 by the transfer roller 150*a* is set to be 1.5–2.5 times larger then pressing forces $P_b$ through $P_d$ by the other transfer rollers 150*b* through 150*d*. In addition, a pressing force $P_d$ to the conveyor belt 222 by the transfer roller 150*d* is set to be 1.5–2.5 times larger then pressing forces $P_a$ through $P_c$ by the other transfer rollers 150*a* through 150$_c$. As a result, if $F_a+F_b<F_t$, and $F_c<F_r$, the color displacement between black and yellow consequently fell within a range from 80 through 120 μm.

Accordingly, the image-forming device according to the present invention can make that color displacement reduced which has been conventionally considered to be a problem to be overcome, and thus form a high-quality image. Resultantly, according to the inventive image-forming device 200, the pressing forces $P_a$ and/or $P_d$ to the conveyor belt 222 by the transfer rollers 150*a* and/or 150*d* may be varied, so that the color displacement can be reduced, and therefore no additional manpower or cost is required, for example, for attaching other parts. Consequently, the inventive image-forming device 200 may form a high-quality image easily and cost-effectively.

A description will be given of operations of the inventive multicolor image-forming device 200. First, a sheet of paper P on top of one or more sheets of paper P stacked on the hopper 205 is dispensed out by the pickup roller 212, and guided by the sheet guide 214 to the sheet feed roller 216. Thereafter, the sheet of paper P is provided with a toner layer formed by the conveyor belt 222 and the driven roller 224 sequentially in the image-forming devices 200*d*. 200*c*, 200*b*, and 200*a* respectively with toner in yellow, magenta, cyan, and black. Then, the toner layer is fixed onto the sheet of paper P by the: fixer 230. In the inventive image-forming device 200, the pressing force $P_a$ and/or $P_a$ applied to the conveyor belt 222 by the transfer rollers 150*a* and/or 150*d* are 1.5–2.5 times larger than the pressing forces $P_b$ and $P_c$ by the other transfer rollers 150*b* and 150*c*. Consequently, the color displacement occurs between a black image and other images of different colors, but falls within a preferred range (equal to or less than 127 μm), and thus a high-quality image may be formed. Thereafter, the sheet of paper P on which toner has been fixed is dispensed out to the stacker 240.

Although the preferred embodiments of the present invention have been described above, various modifications and changes may be made in the present invention without departing from the spirit and scope thereof.

As described above, the image-forming device as one exemplified embodiment of the present invention may provide an image of higher quality with less color displacement than conventional devices by respectively changing pressing forces applied by each process unit to a sheet of paper.

What is claimed is:

1. An image-forming device, comprising:

an endless belt that conveys a recordable medium;

plural image-forming units that form a toner layer on the recordable medium via the endless belt; and a fixer that fixes the toner layer on the recordable medium, wherein a first pressing force applicable to the recordable medium by a last image-forming unit at a downstream side along a direction in which the recordable medium is conveyed among the plural image-forming units is greater than a second pressing force applicable to the recordable medium by another image-forming unit adjacent to the last image-forming unit at the downstream side among the plural image-forming units;

wherein a total of the first and the second pressing forces is smaller than a third pressing force applicable to the recordable medium by the fixer.

2. An image-forming device, comprising:

an endless belt that conveys a recordable medium;

plural image-forming units that form a toner layer on the recordable medium via the endless belt; and a fixer that fixes the toner layer on the recordable medium, wherein a first pressing force applicable to the recordable medium by a last image-forming unit at a downstream side along a direction in which the recordable medium is conveyed among the plural image-forming units is greater than a second pressing force applicable to the recordable medium by another image-forming unit adjacent to the last image-forming unit at the downstream side among the plural image-forming units;

wherein the first pressing force is approximately 1.5 times greater than the second pressing force.

3. An image-forming device, comprising:

an endless belt that conveys a recordable medium;

plural image-forming units that form a toner layer on the recordable medium via the endless belt; and a fixer that fixes the toner layer on the recordable medium, wherein a first pressing force applicable to the recordable medium by a last image-forming unit at a downstream side along a direction in which the recordable medium is conveyed among the plural image-forming units is greater than a second pressing force applicable to the recordable medium by another image-forming unit adjacent to the last image-forming unit at the downstream side among the plural image-forming units;

wherein the first pressing force is approximately 2.5 times greater than the second pressing force.

4. An image-forming device comprising:

an endless belt that conveys a recordable medium;

plural image-forming units that form a toner layer on the recordable medium via the endless belt; and a register section that conveys the recordable medium to the endless belt;

wherein a fourth pressing force applicable to the recordable medium by a first image-forming unit at an upstream side along a direction in which the recordable medium is conveyed among the plural image-forming units is greater than a fifth pressing force applicable to the recordable medium by another image-forming unit adjacent to the first image-forming unit at the upstream side among the plural image-forming units.

5. An image-forming device according, to claim 4, wherein the fourth pressing force is smaller than a sixth pressing force applicable to the recordable medium by the register section.

6. An image-forming device according to claim 4, wherein the fourth pressing force is approximately 1.5 times greater than the fifth pressing force.

7. An image-forming device according to claim 4, wherein the fourth pressing force is approximately 2.5 times greater than the fifth pressing force.

8. An image-forming device, comprising:

an endless belt that conveys a recordable medium;

plural image-forming units that form a toner layer on the recordable medium via the endless belt; and a fixer that fixes the toner layer on the recordable medium, wherein a first pressing force applicable to the recordable medium by a last image-forming unit at a downstream side along a direction in which the recordable medium is conveyed among the plural image-forming units is greater than a second pressing force applicable to the recordable medium by another image-forming unit adjacent to the last image-forming unit at the downstream side among the plural image-forming units:

wherein the plural image-forming units include four image-forming units for yellow, magenta, cyan, an black, each having the same structure; and wherein the last image-forming unit is the image-forming unit for black.

9. An image-forming unit with resolution A comprising:

an endless belt that conveys a recordable medium;

four image-forming units for yellow, magenta, cyan, and black that form a toner layer on the recordable medium via the endless belt;

a fixer that fixes the toner layer on the recordable medium; and a register section that conveys the recordable medium to the endless belt, wherein a pressing force applicable to the recordable medium by the image-forming units, a pressing force applicable to the recordable medium by the fixer, and a pressing force applicable to the recordable medium by the register section are adjusted so that displacement of each color with respect to black may be equal to or less than approximately 3/A.

* * * * *